US007677558B2

(12) United States Patent
Kinoshita et al.

(10) Patent No.: US 7,677,558 B2
(45) Date of Patent: Mar. 16, 2010

(54) SHEET CONVEYING DEVICE AND IMAGE FORMING APPARATUS

(75) Inventors: Hidehiko Kinoshita, Kashiwa (JP); Masaaki Moriya, Moriya (JP); Jun Yamaguchi, Fujisawa (JP); Atsushi Nakagawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 12/060,389

(22) Filed: Apr. 1, 2008

(65) Prior Publication Data

US 2009/0033029 A1 Feb. 5, 2009

(30) Foreign Application Priority Data

Apr. 2, 2007 (JP) ..... 2007-096938

(51) Int. Cl.
*B65H 7/02* (2006.01)

(52) U.S. Cl. ..... 271/227; 271/228; 271/236

(58) Field of Classification Search ..... 271/227, 271/228, 236
See application file for complete search history.

(56) References Cited

U.S. PATENT DOCUMENTS 6,663,103 B2 * 12/2003 Dobberstein et al. ..... 271/227
7,472,905 B2 * 1/2009 Inoue ..... 271/227
2006/0208416 A1 * 9/2006 Dejong et al. ..... 271/228
2008/0012215 A1 * 1/2008 Elliot ..... 271/228
2008/0136094 A1 * 6/2008 Elliot ..... 271/270
2008/0237975 A1 * 10/2008 de Jong et al. ..... 271/228

FOREIGN PATENT DOCUMENTS

JP 2002-019999 A 1/2002

* cited by examiner

*Primary Examiner*—David H Bollinger
(74) *Attorney, Agent, or Firm*—Canon USA Inc IP Division

(57) ABSTRACT

A sheet conveying device for conveying a sheet includes a displacement-amount detector configured to detect an amount of displacement of a conveyed sheet from a conveyance reference in a width direction being substantially perpendicular to a sheet conveying direction and a plurality of sheet conveying roller portions configured to be shiftable in a direction substantially perpendicular to the sheet conveying direction while pinching the sheet having the amount of displacement detected by the displacement-amount detector. Before the sheet reaches the sheet conveying roller portions, the sheet conveying roller portions are shifted based on the amount of displacement detected by the displacement-amount detector from a conveyance-reference position in a direction in which the sheet is displaced. After the sheet reaches the sheet conveying roller portions, the sheet conveying roller portions are shifted while pinching the sheet so as to reduce the amount of displacement.

3 Claims, 17 Drawing Sheets

SHEET CONVEYING DEVICE AND IMAGE FORMING APPARATUS

BACKGROUND OF THE INVENTION

1. Field of the Invention

The present invention relates to a sheet conveying device and an image forming apparatus, and in particular, to a technique for correcting a positional displacement of a sheet in a width direction thereof.

2. Description of the Related Art

A typical image forming apparatus, such as a copier, printer, and a facsimile machine, has a sheet conveying device that conveys a sheet to an image forming portion for forming an image on the sheet.

The sheet conveying device has a skew correcting portion to correct a skew of a sheet and conveys the sheet to the image forming portion. One example technique used in the skew correcting portion is to correct a skew by detecting the amount of skew of a sheet and changing the ratio between revolutions of a pair of conveying rollers arranged in a sheet width direction, to which a sheet conveying direction is perpendicular, or the number of revolutions of each of the conveying rollers.

A positional displacement may occur in a sheet in the sheet width direction during conveyance by the time the sheet reaches the image forming portion. To address this, some sheet conveying devices have a positional displacement correcting portion that corrects the positional displacement by detecting the positional displacement in the sheet width direction using, for example, a sensor, calculating the amount of displacement from a conveyance reference, and shifting the pair of conveying rollers conveying the sheet in the width direction while pinching the sheet according to the calculated amount of displacement.

A sheet conveying device including a skew correcting portion that has a pair of conveying rollers, as described above, first corrects a skew of a sheet using the skew correcting portion. Then, the sheet conveying device corrects a displacement in the sheet width direction using the positional displacement correcting portion. In this way, the sheet is conveyed to an image forming portion along a conveyance reference. One example of such a technique is disclosed in Japanese Patent Laid-Open No. 2002-019999.

A positional displacement correcting portion for correcting a displacement in the sheet width direction in such a known sheet conveying device is composed of a pair of conveying rollers capable of being axially shifted downstream of a skew correcting portion in the sheet conveying direction. The pair of conveying rollers are made to stay at a conveyance reference position, pinch a sheet at that position, and then are shifted in the axial direction based on the amount of displacement from a conveyance reference detected by, for example, a sensor. In this way, the sheet is moved to the conveyance reference position, and a displacement in the sheet width direction is corrected.

FIGS. 17A to 17D illustrate a positional displacement correcting portion in such a known sheet conveying device. In FIGS. 17A to 17D, conveying rollers 305 can be shifted in the axial direction (width direction). A sheet Sa has a length in the width direction of, for example, approximately 330 mm, which corresponds to a size larger than a normal A4-size or A3-size sheet. A sheet Sb is the smallest sheet conveyable by the known sheet conveying device, for example, a B5R-size sheet, whose length in the width direction is approximately 182 mm.

It is necessary to arrange the conveying rollers 305 such that they can be axially shifted while pinching a sheet of all conveyable sizes, so they are arranged so as to conform to the small-size sheet Sb. For example, as illustrated in FIGS. 17A and 17B, the conveying rollers 305 are arranged at a distance x away from a conveyance reference (indicated by dashed lines). The conveyance reference is a line that passes through the center of a conveying path in the width direction. A sheet is conveyed while the center of the sheet in the width direction is aligned with the conveyance reference.

In such a positional displacement correcting portion, when the large-size sheet Sa is conveyed while being largely displaced in the width direction, as illustrated in FIG. 17C, the displacement of the sheet Sa is corrected by movement of the conveying rollers 305 toward the front side in the width direction. The amount of movement of the conveying rollers 305 at this time corresponds to the amount for matching the center of the sheet in the width direction with the conveyance reference. To this end, the positional displacement of the sheet in the width direction is detected by a sensor (not shown), the amount of displacement from the conveyance reference is calculated, and the conveying rollers 305 are moved based on the calculated amount of displacement.

At this time, the conveying rollers 305 are shifted while pinching the large-size sheet Sa at an offset position in the width direction. In this case, the frictional force between the guiding surface of the conveying path and the large-size sheet Sa unbalances the shifting force. That is, because the forces applied to the left and right conveying rollers 305 from the sheet caused by the frictional force are different from each other, slippage occurs between the conveying rollers 305 and the sheet Sa. Thus, the sheet Sa cannot be shifted by the accurate amount. In addition, the frictional force to the guiding surface of the conveying path may cause the sheet to be oblique.

In the case of the small-size sheet Sb, when a displacement of the sheet in the width direction is large, a side end of the small-size sheet Sb may be positioned inside the outer edge of one of the conveying rollers 305, as illustrated in FIG. 17D. In this case, because both the frictional forces to the guiding surface of the conveying path and the forces of pinching the sheet are different between the left and right conveying rollers 305, the lateral shifting force is unbalanced. As a result, slippage occurs and the sheet Sb cannot be shifted by the accurate amount.

As described above, when the conveying rollers 305 are arranged leftward and rightward at a distance x from a sheet conveyance reference, there is a possibility that a displacement is not corrected with high precision.

SUMMARY OF THE INVENTION

The present invention provides a sheet conveying device and an image forming apparatus that can correct a displacement with high precision even when the displacement of the sheet in the width direction is large.

According to an aspect of the present invention, a sheet conveying device for conveying a sheet includes a displacement-amount detector and a plurality of sheet conveying roller portions. The displacement-amount detector is configured to detect an amount of displacement of a conveyed sheet from a conveyance reference in a width direction being substantially perpendicular to a sheet conveying direction. The plurality of sheet conveying roller portions are configured to be shiftable in a direction substantially perpendicular to the sheet conveying direction while pinching the sheet having the amount of displacement detected by the displacement-amount detector. Before the sheet reaches the sheet conveying roller portions, the sheet conveying roller portions are shifted based on the amount of displacement detected by the displacement-amount detector from a conveyance-reference position in a direction in which the sheet is displaced. After the sheet reaches the sheet conveying roller portions, the sheet conveying roller portions are shifted while pinching the sheet so as to reduce the amount of displacement.

Further features of the present invention will become apparent from the following description of exemplary embodiments with reference to the attached drawings.

DESCRIPTION OF THE EMBODIMENTS

Embodiments of the present invention will now be described below with reference to the accompanying drawings.

Figure 1:
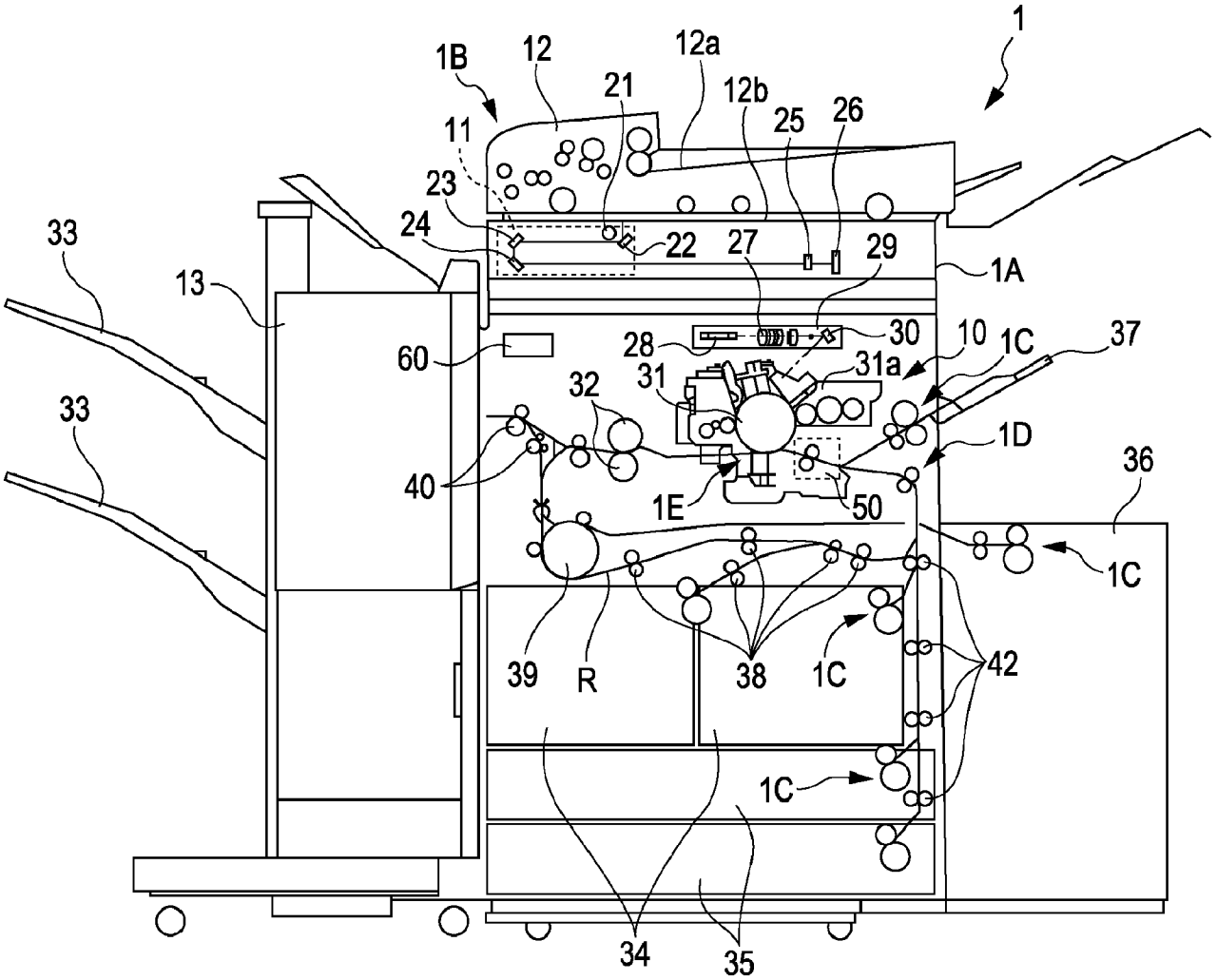
FIG. 1 illustrates a structure of a digital copier being one example of an image forming apparatus that has a sheet conveying device according to a first embodiment of the present invention.

FIG. 1 illustrates a structure of a digital copier being one example of an image forming apparatus that has a sheet conveying device according to a first embodiment of the present invention.

As illustrated in FIG. 1, a digital copier 1 includes a main body 1A thereof, an image reader device 1B configured to read a document image, and a sheet processing device 13 configured to process a sheet S ejected from the main body 1A. The image reading device 1B is disposed above the main body 1A. The sheet processing device 13 is disposed at a side of the main body 1A.

The image reading device 1B includes a platen glass 12*b* serving as an original plate, a scanner unit 11 configured to read a document image, and a document feeder 12 for feeding a document to the platen glass 12*b*.

The main body 1A includes an image forming unit 10 having a photosensitive drum 31, a sheet feeding unit 1C configured to feed a sheet supported on sheet cassettes 34 and 35, and a sheet conveying device 1D configured to convey a sheet fed by the sheet feeding unit 1C to the image forming unit 10. Fixing rollers 32 for fixing a toner image on a sheet and a pair of eject rollers 40 are arranged downstream of the image forming unit 10.

The sheet processing device 13 ejects sheets while sorting sheets output from the main body 1A to paper output trays (bins) 33. The paper output trays 33 are controlled by a control unit (not shown) included in the sheet processing device 13 or a control unit 60 in the main body 1A. Output sheets are sorted to the paper output trays 33 instructed by the control unit 60.

The sheet conveying device 1D includes a sheet correcting unit 50 configured to correct a skew of a sheet and displacement of the sheet in the width direction and a plurality of conveying rollers 38, 39, and 42 each independently connected to a stepping motor (not shown) serving as a driving source via a transmission device, such as a gear.

In the present embodiment, the photosensitive drum 31 is driven by a brushless DC motor. The rotational speed (process speed) of each of the photosensitive drum 31 and the fixing rollers 32 largely depends on the shape and the fixing properties of toner and the light-emitting properties of a laser. Therefore, this process speed is characteristic of a digital copier, so it cannot be controlled in a variable manner. As a result, as the driving source for the photosensitive drum 31 and the fixing rollers 32, a motor that can output a torque sufficient for conveying thick paper is selected.

In contrast, the conveying rollers 38, 39, and 42 are driven at as high speed as possible when any of the fixing rollers 32 and photosensitive drum 31 does not pinch a sheet because the conveying rollers 38, 39, and 42 perform only conveyance of sheets. This aims to reduce the distance between sheets as much as possible and improve the productivity of the digital copier 1.

In FIG. 1, a paper feed deck 36 is disposed at a side of the main body 1A and supports a large quantity of sheets. A manual-bypass tray 37 is disposed at the side of the main body 1A. To feed a small number of sheets of any type or a special sheet, such as an overhead transparency, a sheet of thick paper, and a post-size sheet, an operator uses the manual-bypass tray 37. The manual-bypass tray 37 allows the operator to supply such a sheet relatively easily.

An image forming operation performed in the main body 1A having the above-described structure will now be described below.

When a start button (not shown) is pressed, documents placed on a document tray 12*a* of the document feeder 12 are sequentially conveyed onto the platen glass 12*b* one by one by the document feeder 12. When a document is conveyed, a lamp 21 of the scanner unit 11 illuminates, and the scanner unit 11 is moved by an optical motor (not shown) and irradiates the document.

Light reflected from the document passes through a lens 25 via mirrors 22, 23, and 24 and then enters a CCD sensor 26 serving as an image sensor. The CCD sensor 26 is composed of an element that converts light into an electric signal. The action of the element converts a transmitted optical image into an electric signal and then into a digital signal (image data). The image data of a scanned document is subjected to various correction processing and user-desired image processing and is then stored in an image memory (not shown).

Figure 2:
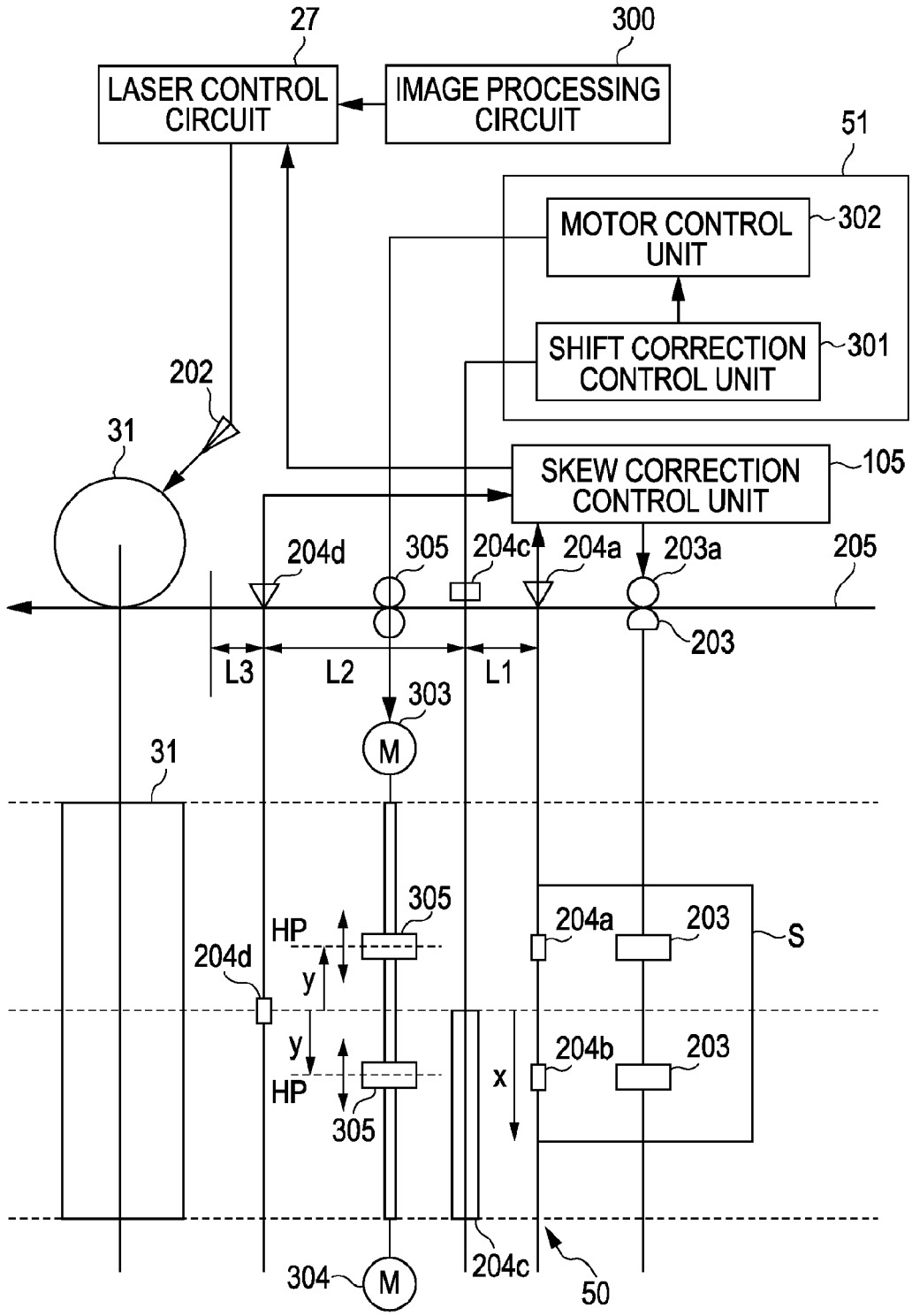
FIG. 2 illustrates a structure and a control block diagram of a sheet correcting unit included in the sheet conveying device.

The image data is read from the image memory, and the image data is reconverted from the digital signal to an analog signal by an image processing circuit 300, which is illustrated in FIG. 2 described below. The signal is amplified to an appropriate output value by a laser control circuit 27 (illustrated in FIG. 2) and is converted into an optical signal by a laser element 202 (illustrated in FIG. 2) in a scanner 28.

The optical signal propagates through the scanner 28, a lens 29, and a mirror 30, and the photosensitive drum 31 is irradiated with the optical signal. In response to this, the photosensitive drum 31 has an electrostatic latent image formed thereon. The electrostatic latent image is developed by a developing unit 31*a*, and thus a toner image is formed on the photosensitive drum 31.

In parallel with the image forming operation, a sheet is fed from the sheet cassette 34 or 35, the paper feed deck 36, or the manual-bypass tray 37 by the sheet feeding unit 1C. The sheet is conveyed to the sheet correcting unit 50 of the sheet conveying device 1D. A skew and positional displacement of the sheet is corrected by the sheet correcting unit 50, and the sheet is then conveyed to a transferring unit 1E.

The toner image is transferred onto the sheet by the transferring unit 1E. Then, the sheet with the toner image transferred thereon is conveyed to the fixing rollers 32. The sheet is heated and pressed by the fixing rollers 32, and the toner image is permanently fixed on the sheet. The sheet with the image fixed thereon is ejected from the main body 1A by the pair of eject rollers 40 and is conveyed to the sheet processing device 13.

To form an image on each of both sides, a sheet S that passed through the fixing rollers 32 is reversed by a reversal path R, then conveyed to the image forming unit 10 (transferring unit 1E) again, and an image is formed on the back side. The sheet S is conveyed to the sheet processing device 13 by the pair of eject rollers 40.

The digital copier 1 of the present embodiment uses a structure that conveys a sheet S while matching the center of the sheet S in the width direction with the center of a sheet conveying path, which is the so-called center reference structure. The center of the sheet conveying path is used as the sheet conveyance reference, so a sheet is conveyed while being matched with the conveyance reference.

FIG. 2 illustrates a structure and a control block diagram of the sheet correcting unit 50 disposed upstream of the photosensitive drum 31 in the sheet conveying direction.

In FIG. 2, the sheet conveying path is indicated by the reference numeral 205. Skew correction rollers 203 are configured to correct a skew of a sheet. A driven roller 203*a* is rotated so as to follow rotation of each of the skew correction rollers 203. The skew correction rollers 203 are disposed in a pair in a direction substantially perpendicular to the sheet conveying direction and are independently controlled by different motors.

The outer edge of each of the skew correction rollers 203 is cut in part. During a stand-by state waiting for sheet conveyance after completion of skew correction, the cut portion faces up so that the skew correction roller 203 is not pressed against the driven roller 203*a* disposed thereabove. This enables the skew correction rollers 203 to be separated from a sheet during a shift operation of a pair of correction (shift) rollers 305, which will be described below, so the rollers do not obstruct shifting the sheet.

Skew sensors 204*a* and 204*b* detect skew of a sheet being conveyed along the sheet conveying path 205. The amount of skew is calculated based on detection performed by the skew sensors 204*a* and 204*b*. The skew correction rollers 203 correct the skew of the sheet based on the calculated amount of skew.

By use of this configuration, the sheet S conveyed along the sheet conveying path 205 can be sent to the image forming unit without being stopped. As illustrated in FIG. 2, the skew sensors 204*a* and 204*b* are disposed in a direction substantially perpendicular to the sheet conveying direction, and the number of the skew sensors 204*a* and 204*b* is, for example, two. The skew sensors 204*a* and 204*b* are connected to a skew correction control unit 105.

When the skew sensors 204*a* and 204*b* detect the leading end of the sheet S, the skew correction control unit 105 calculates the amount of skew of the sheet in response to the detection signal and controls driving of the skew correction rollers 203 in accordance with the calculated amount of skew.

Figure 3:
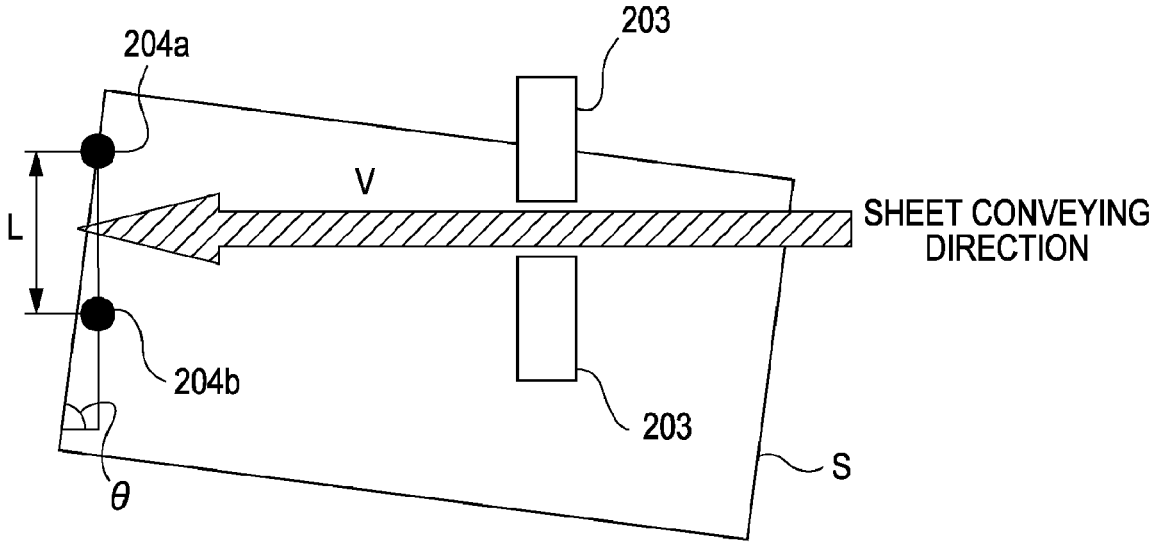
FIG. 3 is a schematic diagram for describing a process for calculating the amount of skew of a sheet performed in the sheet correcting unit.

FIG. 3 is a schematic diagram for describing a process for calculating the amount of skew of the sheet S using two sensors.

In FIG. 3, the skew sensors 204*a* and 204*b* are first and second reflective optical sensors. When the sheet S is conveyed in a state illustrated in FIG. 3, the skew sensor 204*b* first detects the passage of the sheet S, and then the skew sensor 204*a* detects the passage of the sheet S.

The skew correction rollers 203 are driven by a pulse motor. The conveying speed of the sheet S can be calculated from a step angle and timing of outputting a pulse. The amount of skew of the sheet S can be calculated by detection of the time when the sheet S exits performed by the skew sensors 204*a* and 204*b*.

The angle of skew θ can be represented by $$\theta=\tan^{-1}(L/V\cdot T)$$

where L is the distance between the skew sensors 204*a* and 204*b*, V is the sheet conveying speed, and T is the time from detection of the sheet by the skew sensor 204*b* to detection of the sheet by the skew sensor 204*a*.

The skew correction control unit 105 corrects the skew of the sheet S by controlling rotation of the two skew correction rollers 203 based on the amount of skew of the sheet S determined in this way. In the present embodiment, the skew of the sheet S is corrected by changing of the ratio between the revolutions of the skew correction rollers 203 or the number of revolutions of each of the skew correction rollers 203.

In FIG. 2, a position displacement sensor 204*c* is a side-end sensing portion for detecting the position of a side end of a sheet in the sheet width direction (in a direction substantially perpendicular to the sheet conveying direction). One example of the position displacement sensor 204*c* is an image reading sensor (image sensor) for reading an image, such as a charge-coupled device (CCD) or a contact image sensor (CIS).

A leading-end detecting sensor 204*d* detects the leading end of a sheet whose displacement from the conveyance reference in the sheet width direction has been corrected. The control unit 60 (see FIG. 1) synchronizes a detection signal of the position of the sheet from the leading-end detecting sensor 204*d* with an image formation timing signal.

The position displacement sensor 204*c* is disposed between the photosensitive drum 31 and the skew sensors 204*a* and 204*b*. The distance between the position displacement sensor 204*c* and the skew sensors 204*a* and 204*b* is L1. The leading-end detecting sensor 204*d* is disposed between the photosensitive drum 31 and the skew sensors 204*a* and 204*b*. The distance between the leading-end detecting sensor 204*d* and the skew sensors 204*a* and 204*b* is L1+L2. The position displacement sensor 204*c* extends from the conveyance reference to one side substantially perpendicular to the sheet conveying direction.

To perform an image forming operation, as previously described, a sheet being in a state in which skew is corrected by the skew correction rollers 203 is conveyed toward the photosensitive drum 31 along the sheet conveying path 205. At this time, it is necessary to detect the time when the sheet S is conveyed in the sheet conveying direction and to control the time of emitting a laser beam onto the photosensitive drum 31.

In the present embodiment, the control unit 60 starts irradiation of the photosensitive drum 31 with a laser beam when the sheet proceeds by the distance L3 after the leading end of the sheet is detected by the leading-end detecting sensor 204*d*. Therefore, the position of irradiation with a laser beam in the sheet conveying direction can be adjusted.

The pair of shift rollers 305 are sheet conveying roller portions that can convey a sheet and be shifted in a direction substantially perpendicular to the sheet conveying direction (sheet width direction) while pinching the sheet. The pair of shift rollers 305 are coaxially disposed in a direction substantially perpendicular to the sheet conveying direction. Each of the pair of shift rollers 305 includes a driving roller driven by a convey motor and a driven roller following movement of the driving roller. The pair of shift rollers 305 are shifted by a shift motor 303 being a shift portion in a direction substantially perpendicular to the sheet conveying direction, based on the amount of displacement detected by the position displacement sensor 204*c*, while pinching a sheet (hereinafter referred to as shift correction).

A convey motor 304 rotates the pair of shift rollers 305 in the sheet conveying direction. The shift motor 303 and the convey motor 304 enable the pair of shift rollers 305 to convey a sheet while being shifted. Each of the shift motor 303 and the convey motor 304 is a stepping motor and is connected to the pair of shift rollers 305 via a transmission device (not shown), such as gearing.

Figure 17A:
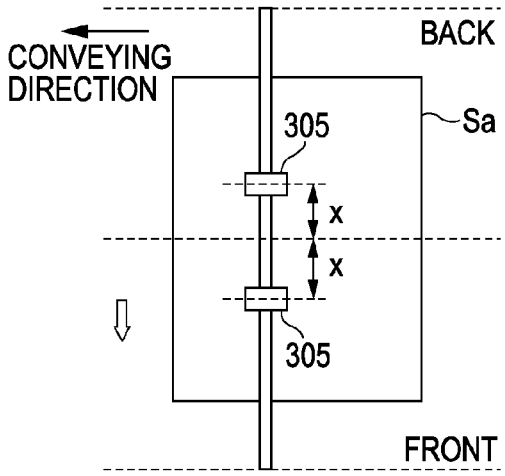
FIGS. 17A to 17D illustrate a structure of a positional displacement control portion in a known sheet conveying device.
Figure 17B:
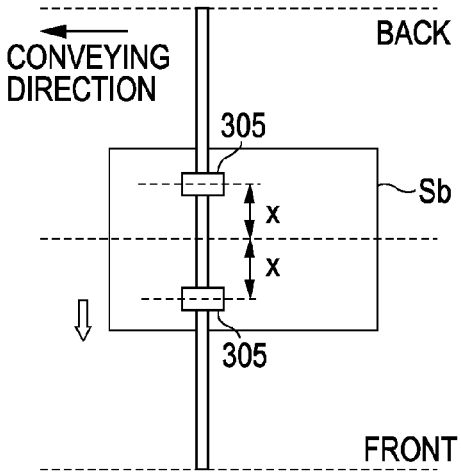
Figure 17C:
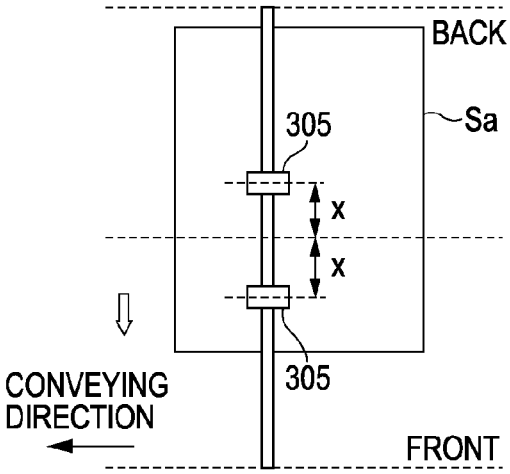
Figure 17D:
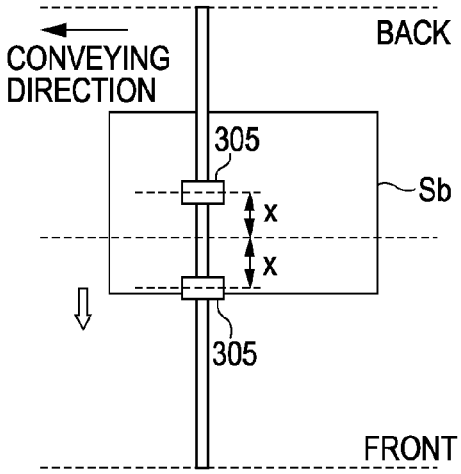

Before shift correction, each of the pair of shift rollers 305 waits at a distance y from the center in a direction substantially perpendicular to the sheet conveying direction (conveyance reference) in the sheet conveying path 205 based on the detection performed by a home position (HP) sensor (not shown). This waiting position is a position where displacement does not occur in an actual operation and where both a large sheet and a small sheet can be conveyed when no shift correction is necessary (see FIGS. 17A and 17B).

In the present embodiment, the position at the distance y from the conveyance reference in the sheet conveying path 205 is set as the HP of each of the pair of shift rollers 305. However, a position at a predetermined distance from an end of the sheet conveying path 205 may be set as the HP.

To adjust positional displacement of a sheet in the width direction, first the position displacement sensor 204*c* detects the position of a side end of the sheet S, and then the amount of displacement Δx of the sheet side end is detected based on the detection. The amount of shift of the pair of shift rollers 305 is calculated based on the amount of displacement Δx.

The pair of shift rollers 305 are shifted from the waiting position by the calculated amount of shift such that the center of the gap between the pair of shift rollers 305 (between the sheet conveying roller portions) matches with the center of a sheet being conveyed in the width direction. While the pair of shift rollers 305 pinch the sheet, the pair of shift rollers 305 are shifted such that the center of the gap between the pair of shift rollers 305 matches with the conveyance reference.

Figure 4:
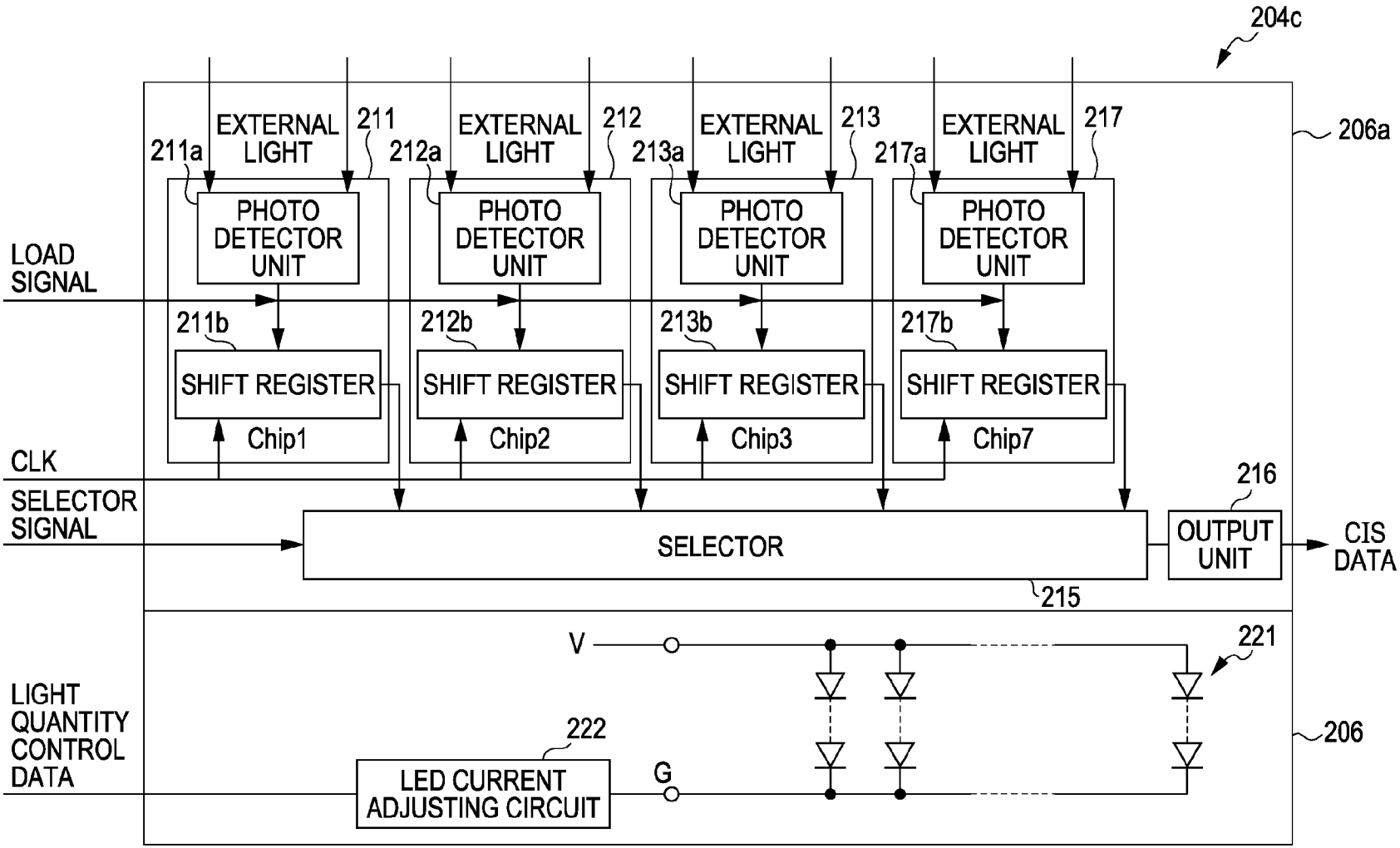
FIG. 4 is a block diagram of a position displacement sensor included in the sheet correcting unit.

FIG. 4 is a block diagram of the position displacement sensor 204*c*. As illustrated in FIG. 4, the position displacement sensor 204*c* includes an image reader 206*a* and an LED section 206. The image reader 206*a* includes a plurality of chips, in the present embodiment, four chips 211 to 217, a selector 215, and an output unit 216. The chips 211 to 217 include photo detector units 211*a* to 217*a* and shift registers 211*b* to 217*b*, respectively, and in other words, one chip accommodates a photo detector unit and a shift register. Each of the photo detector units 211*a* to 217*a* has 1000 reading pixels.

The selector 215 selects all chips or a specific chip in response to a selector signal from a shift correction control unit 301, which is illustrated in FIG. 2. When the selector 215 selects only one specific chip, for example, the chip 211, an image signal detected by the photo detector unit 211*a* is temporarily read by the shift register 211*b* in response to a load signal (CIS-SH) from the shift correction control unit 301.

Then, in accordance with a clock (CLK) from the shift correction control unit 301, image signals are sequentially transferred from the shift register 211*b* to the output unit 216 via the selector 215. The output unit 216 converts the transferred serial image signals into parallel data and outputs it as positional displacement data.

When the selector 215 selects all of n chips, in the present embodiment, the seven chips 211 to 217, image signals detected by the photo detector units 211*a* to 217*a* are temporarily read by the shift registers 211*b* to 217*b* in response to load signals from the shift correction control unit 301. Then, in accordance with clocks (CLKs) from the shift correction control unit 301, the image signals are sequentially transferred from the shift registers 211*b* to 217*b* to the output unit 216 via the selector 215. The output unit 216 converts the transferred serial image signals into parallel data and outputs it as positional displacement data.

Therefore, the position displacement sensor 204*c* can select only part of the chips and read its data only or select all of the chips and read their data at a time.

The LED section 206 includes an LED portion 221 in which LED elements in series are connected in parallel and an LED current adjusting circuit 222 connected to cathodes of the LED elements and adjusting current passing through the LED elements. The LED current adjusting circuit 222 adjusts the overall quantity of light emission of the LED portion 221 in accordance with data for controlling light quantity from the shift correction control unit 301.

Figure 5:
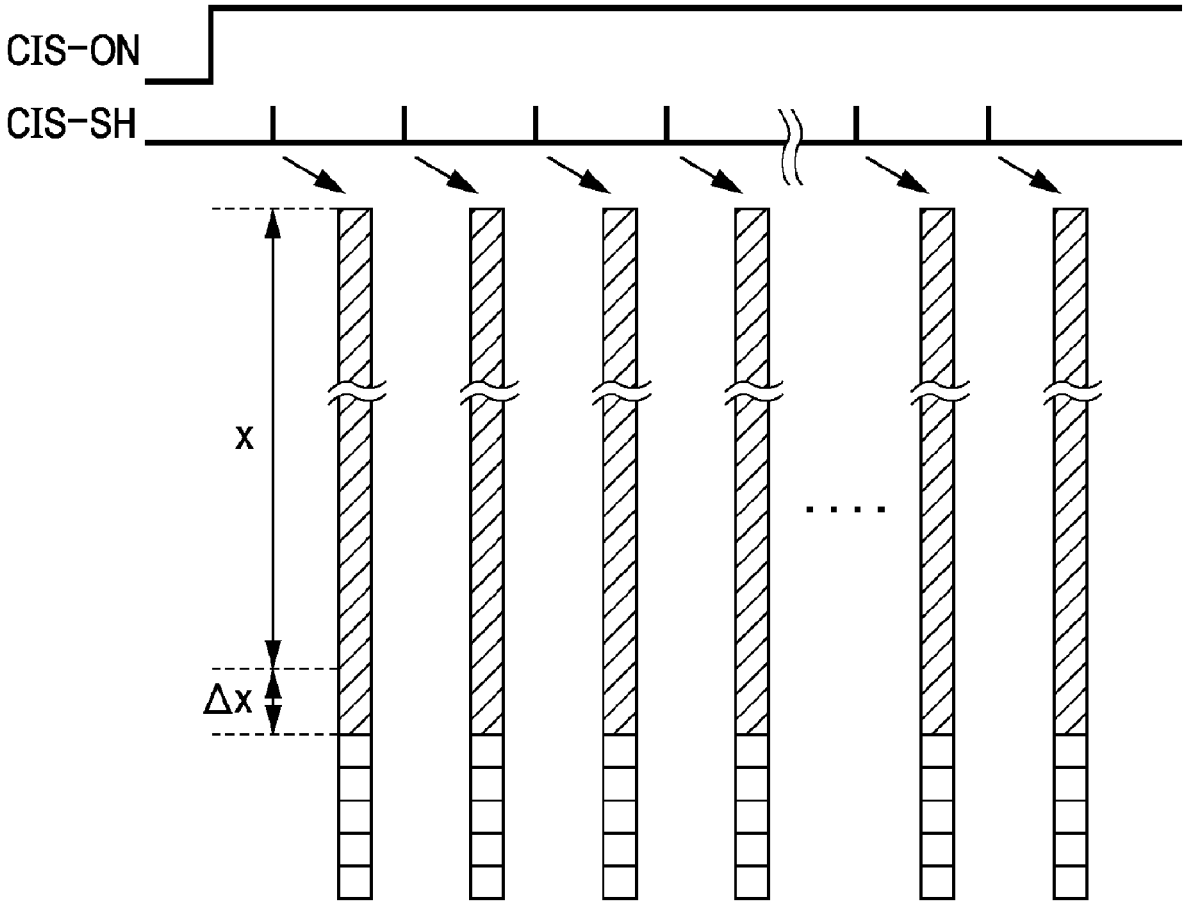
FIG. 5 illustrates a region where the positional displacement detecting sensor detects a sheet.

FIG. 5 is an illustration for describing detection of the amount of displacement of a sheet in a direction substantially perpendicular to the sheet conveying direction performed by the position displacement sensor 204*c*. When the position displacement sensor 204*c* starts a detection operation in response to a CIS-ON signal, the position displacement sensor 204*c* reads data, and data is read with timing of the CIS-SH. From the read data, the amount of displacement Δx being the difference to an ideal value x at which no displacement occurs in the sheet (x is a value that corresponds to the half length of the sheet in the width direction) is detected. In this case, Δx is calculated by averaging data of a predetermined number of lines.

Figure 6:
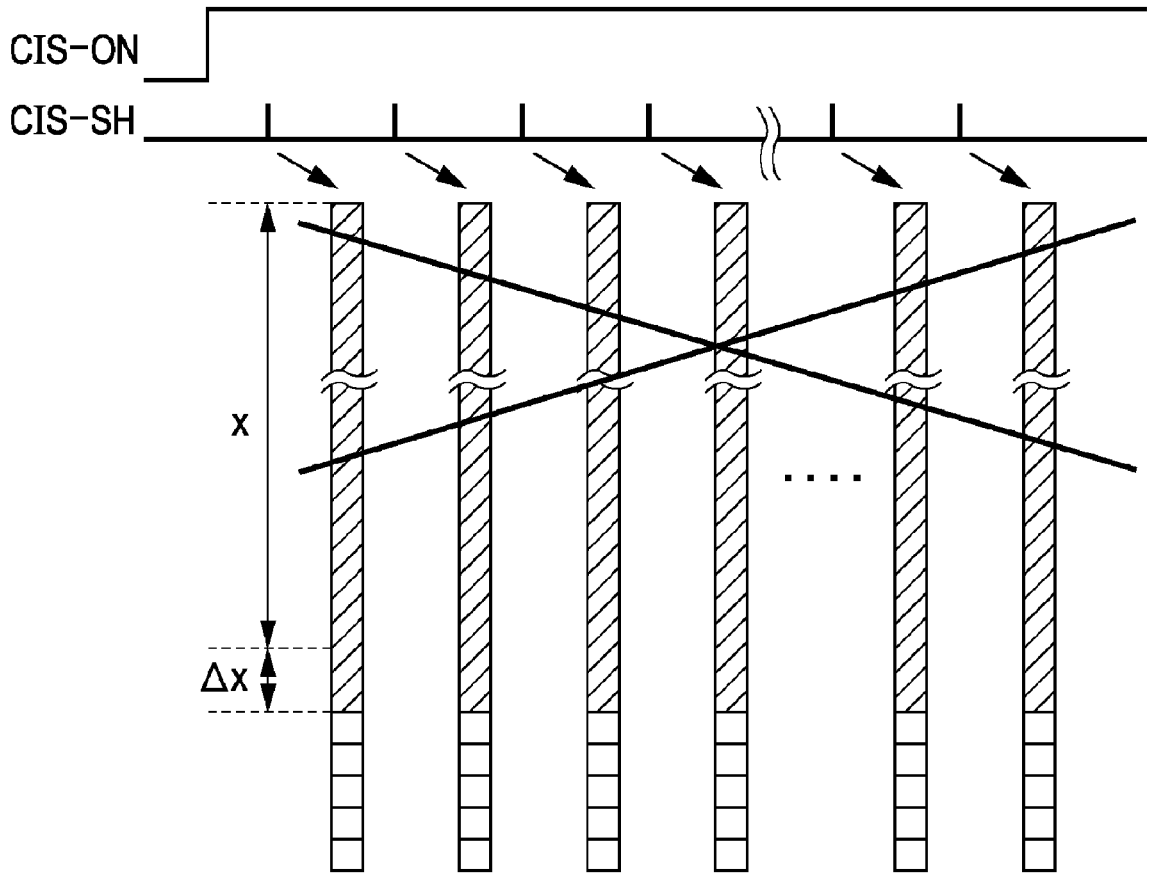
FIG. 6 is another illustration that shows a region where the positional displacement detecting sensor detects a sheet.

Because the position displacement sensor 204*c* can select a specific chip and carry out detection, as illustrated in FIG. 6, the amount of displacement Δx can be detected by selection of one or more chips in a predetermined range of the ideal value x and performance of detection. In this case, it is possible that data unnecessary for detection is not captured as much as possible by not obtaining data from an unselected chip (indicated by x in the drawing).

Figure 7:
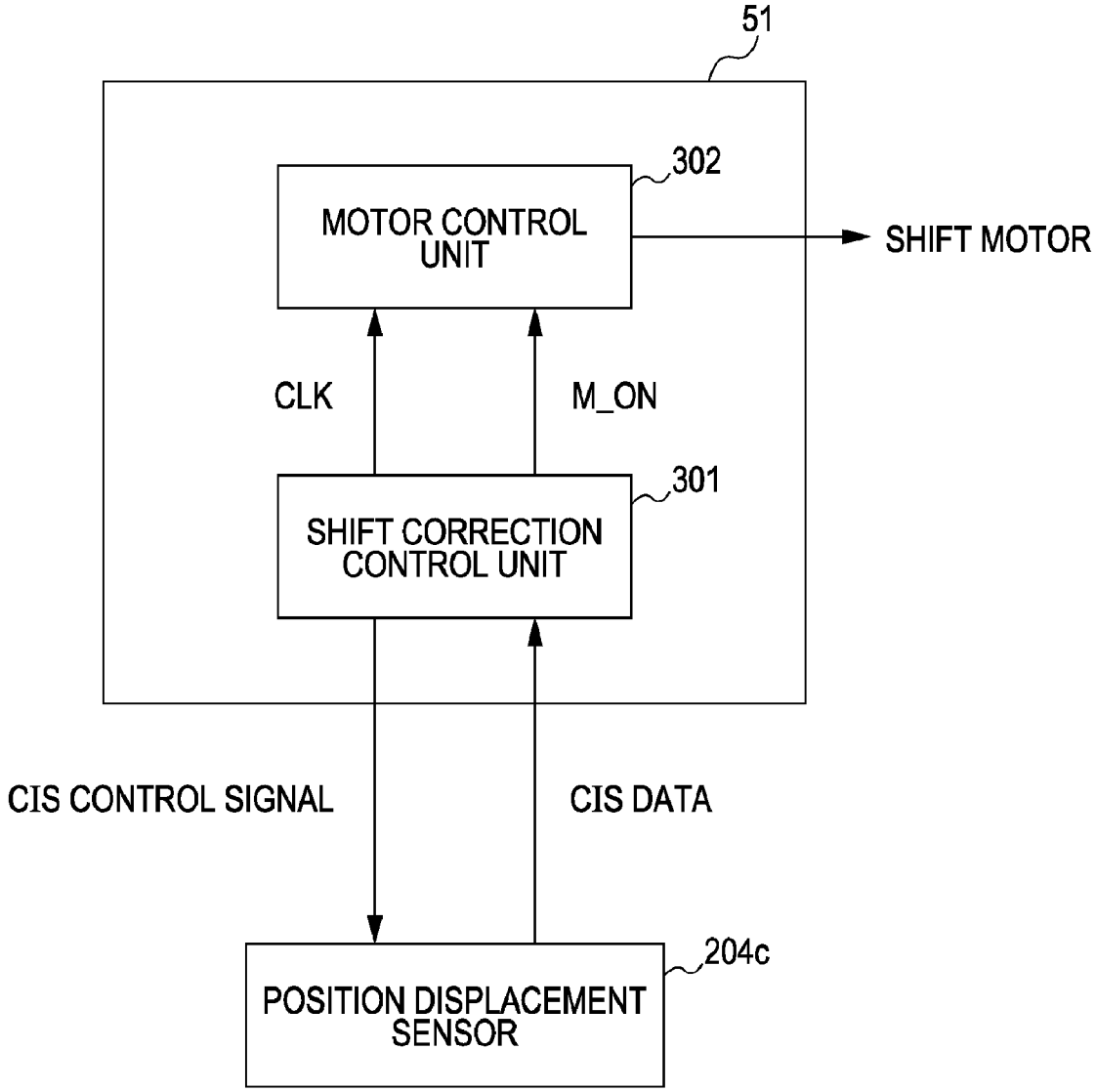
FIG. 7 is a block diagram of a positional displacement controller included in the sheet correcting unit.

In FIG. 2, a positional displacement controller 51 is configured to control correction of a positional displacement. The positional displacement control unit 51 includes the shift correction control unit 301 and a motor control unit 302, as illustrated in FIG. 7. The positional displacement controller 51 dedicated to correction of a positional displacement may be used. Alternatively, the control unit 60, which is described above, may function as the positional displacement controller 51. The control unit 60 may also function as the skew correction control unit 105.

The motor control unit 302 being a shift drive control unit outputs a driving signal to the shift motor in response to a signal output based on the amount of displacement calculated by the shift correction control unit 301.

The shift correction control unit 301 outputs a position displacement sensor control signal (CIS control signal) to the position displacement sensor 204*c*. The shift correction control unit 301 receives positional displacement data (CIS data) read by the position displacement sensor 204*c*, calculates the amount of displacement based on the positional displacement data, and outputs a motor-on (M_ON) signal and a clock (CLK) to the motor control unit 302. The position displacement sensor 204*c* and the shift correction control unit 301 constitute a displacement-amount detector.

Figure 8:
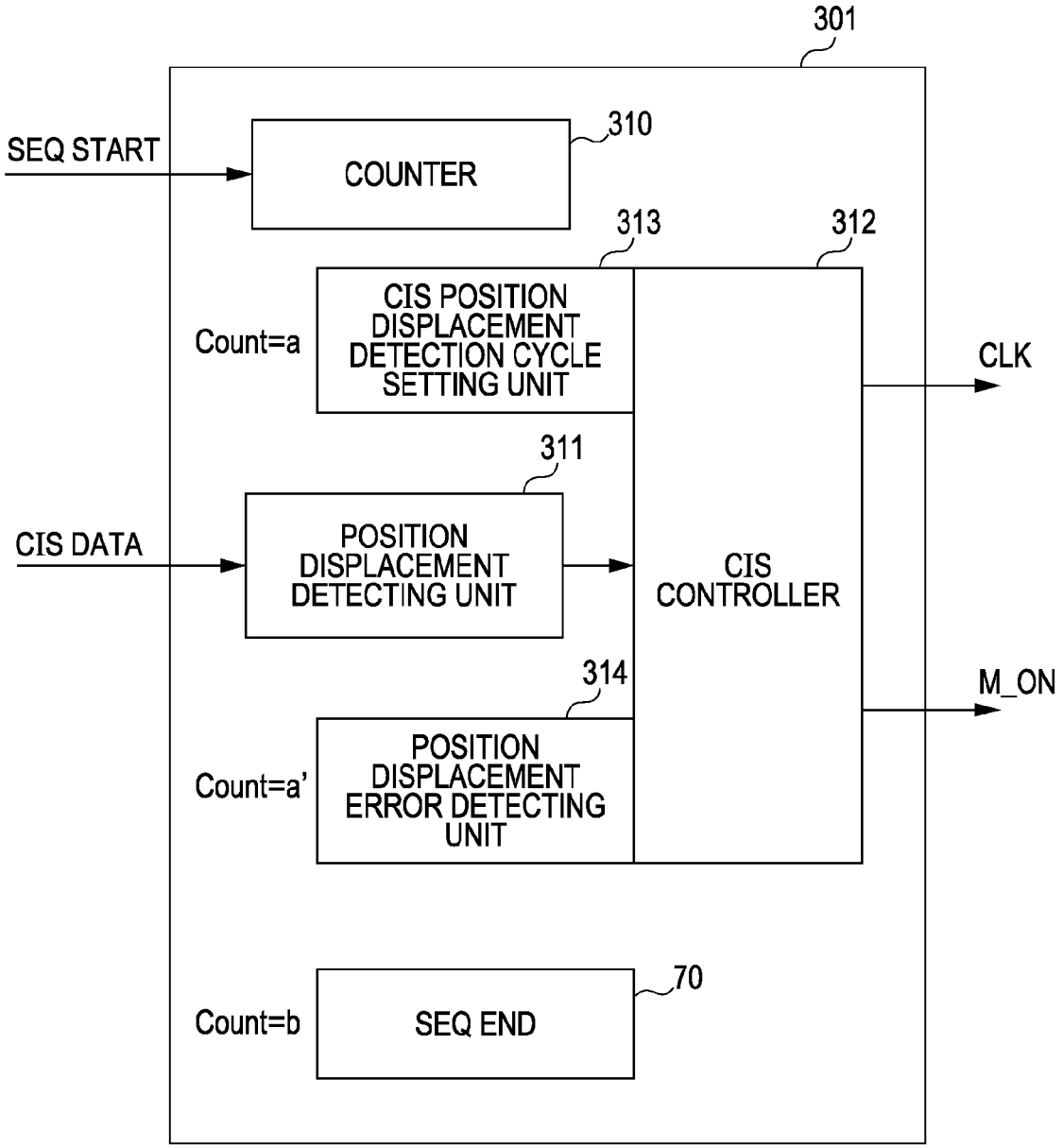
FIG. 8 is a block diagram of a structure of a shift correction control unit included in the positional displacement controller.

FIG. 8 is a block diagram of a structure of the shift correction control unit 301. The shift correction control unit 301 includes a counter 310, a CIS position displacement detecting unit 311, a CIS controller 312, a CIS position displacement detection cycle setting unit 313, a position displacement error detecting unit 314, and a sequence end setting unit (SEQ END) 70.

The counter 310 is initiated in response to a sequence start signal (SEQ START) and counts a clock of a predetermined cycle. The CIS position displacement detecting unit 311 detects the position of displacement of a sheet based on positional displacement data input from the position displacement sensor 204*c*.

The CIS controller 312 outputs a control signal for the position displacement sensor, such as a load signal (CIS-SH), clock (CIS-CLK), motor driving signal (M_ON), selector signal, and light-quantity control data, to the position displacement sensor 204*c*. To detect a positional displacement of a sheet, a cycle of the load signal (CIS-SH) input to the position displacement sensor 204*c* is set in the CIS position displacement detection cycle setting unit 313.

The position displacement error detecting unit 314 generates an error signal (ERR) when the position of a side end of a sheet detected by the CIS position displacement detecting unit 311 falls outside a predetermined range (e.g., 15 mm). A count value of a sequence for finishing printing of a single sheet is set in the sequence end setting unit (SEQ END) 70.

An operation of control of shift correction of positional displacement according to the present embodiment will now be described with reference to FIG. 9.

Figure 9:
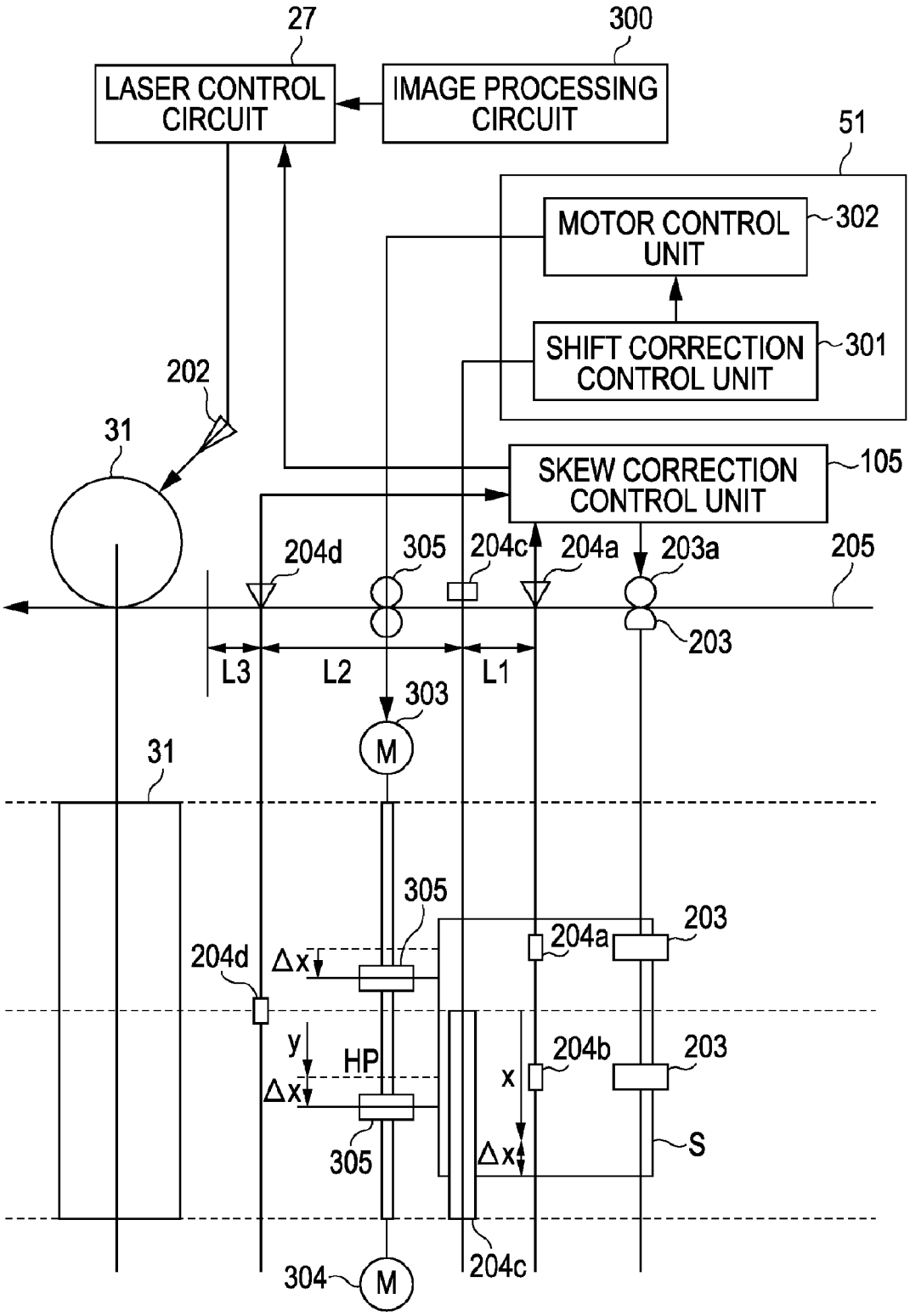
FIG. 9 is a first illustration for describing how the sheet correcting unit corrects a positional displacement of a sheet.

FIG. 9 illustrates a sheet S before shift correction of positional displacement is performed. The sheet S is being conveyed in a state in which the sheet S is displaced from the conveyance reference by Δx in a direction substantially perpendicular to the sheet conveying direction after the skew of the sheet S is corrected by the skew correction rollers 203. The sheet S conveyed in such a state in which the sheet S is displaced by Δx in a direction substantially perpendicular to the sheet conveying direction passes through the position displacement sensor 204*c*.

When the sheet S passes in such a way, the positional displacement controller 51 (shift correction control unit 301) detects the amount of displacement from the ideal value x at which the sheet S would be conveyed without positional displacement, as illustrated in FIG. 9. The ideal value x is z/2 where z is the length of the sheet S in the width direction.

For example, when the sheet S is an A4-size sheet, because the length of the sheet S in the width direction is approximately 297 mm, the ideal value x is approximately 148 mm; when it is a B5R-size sheet, because the length of the sheet S in the width direction is approximately 182 mm, the ideal value x is approximately 91 mm.

After the amount of displacement Δx from the ideal value x is detected according to sheet sizes, the positional displacement controller 51 shifts the pair of shift rollers 305 by Δx in a direction substantially perpendicular to the sheet conveying direction via the motor control unit 302. When the amount of displacement toward the front side in the sheet conveying path 205 is +Δx and that toward the back side in the sheet conveying path 205 is −Δx, in the case of FIG. 9, the displacement occurs in the front side in the sheet conveying path 205. In this case, by shifting the pair of shift rollers 305 toward the conveyance reference in the sheet conveying path 205 by Δx, the positional displacement of the sheet S in the width direction is corrected.

In the present embodiment, when the amount of displacement Δx is calculated, the positional displacement controller 51 then drives the shift motor 303 using the motor control unit 302. Driving of the shift motor 303 in such a way shifts the pair of shift rollers 305 by Δx before the sheet S reaches the pair of shift rollers 305.

That is, when the amount of displacement Δx is calculated, the positional displacement controller 51 then moves each of the pair of shift rollers 305 to a position shifted from a waiting position indicated by dashed lines by the amount of displacement Δx in a direction in which the sheet is displaced (hereinafter referred to as a displaced direction) before the sheet S reaches the pair of shift rollers 305.

Figure 10:
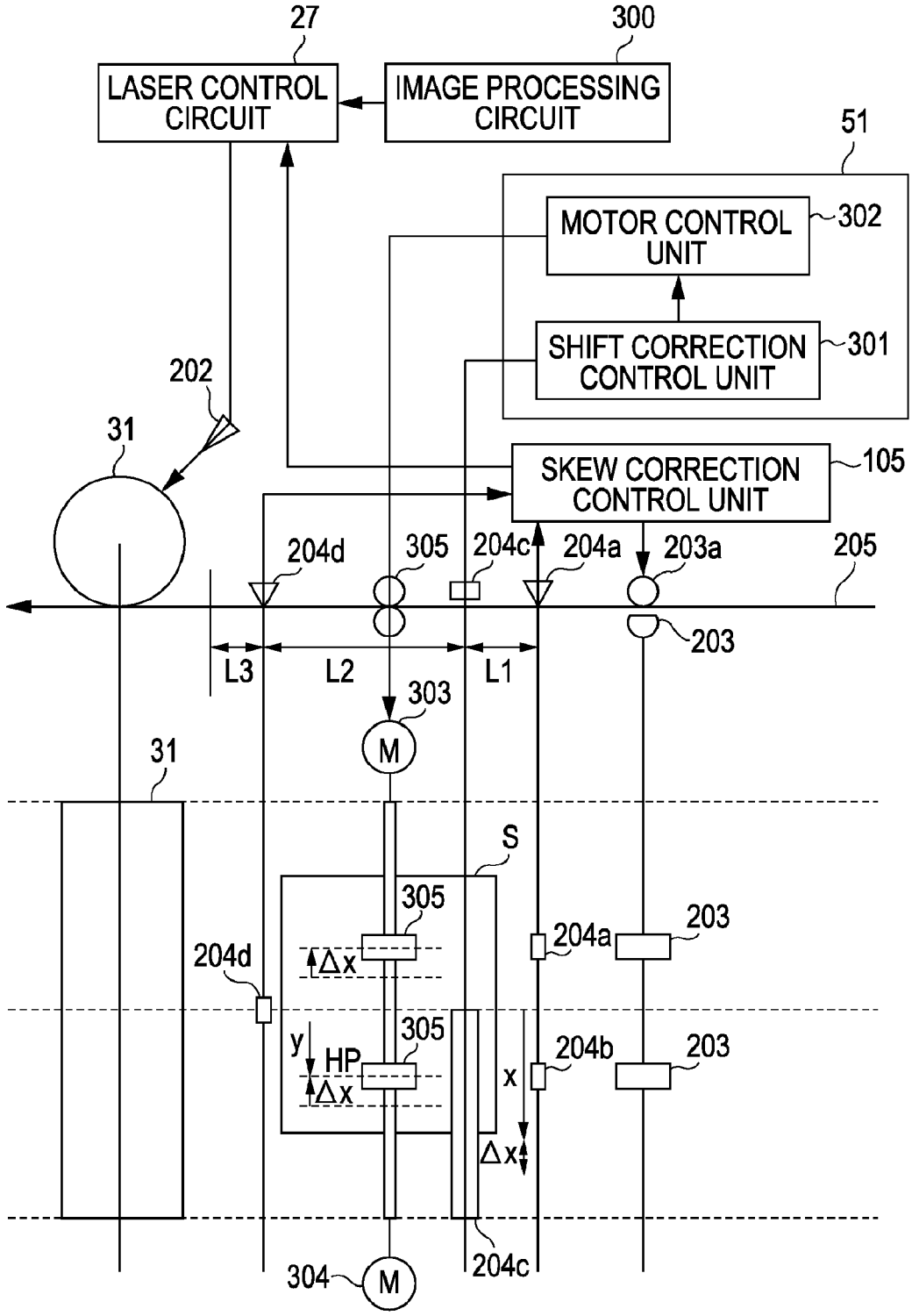
FIG. 10 is a second illustration for describing how the sheet correcting unit corrects a positional displacement of a sheet.

Therefore, irrespective of the size of the sheet S or the amount of displacement Δx, the pair of shift rollers 305 can always pinch the sheet S at balanced positions to the sheet S, that is, positions at the same distance y from the center of the sheet S in the width direction, as illustrated in FIG. 10. After that, the pair of shift rollers 305 are shifted in a direction opposite to the displaced direction while pinching the sheet S at those positions. Therefore, the sheet can be shifted in a balanced manner, so the shift operation with less slippage can be performed with high precision.

When the pair of shift rollers 305 are shifted by Δx in response to detection of the amount of displacement Δx and are made to wait prior to a shift operation and then the shift operation is performed by Δx, the pair of shift rollers 305 are always returned to the HP. Therefore, even when the sheet conveying speed of the sheet S is so fast that the gap time between sheets is short, this does not affects on the throughput because it is not necessary to return each of the pair of shift rollers 305 to the HP.

Figure 11:
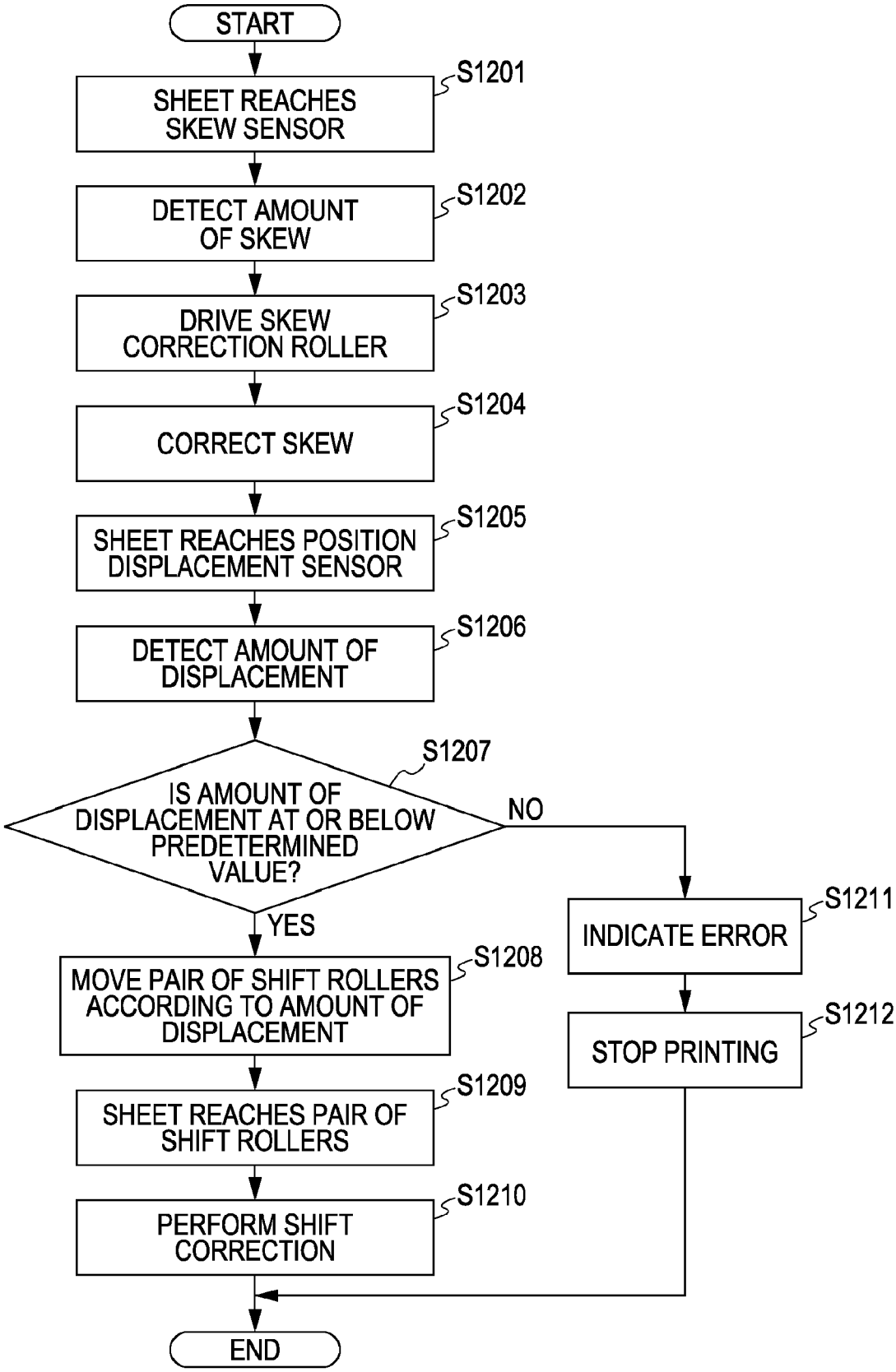
FIG. 11 is a flowchart that illustrates a process for correcting a skew and a positional displacement performed by the sheet correcting unit.

An operation of skew correction and shift control will be described below with reference to the flowchart of FIG. 11.

When the sheet S reaches a sensing area of the skew sensors 204*a* and 204*b*, as illustrated in FIG. 2 (S1201), the skew correction control unit 105 detects the amount of skew in response to a signal from the skew sensors 204*a* and 204*b* (S1202). The skew correction control unit 105 drives the skew correction rollers 203 in accordance with the detected amount of skew (S1203), and an operation of skew correction is completed (S1204).

The sheet S whose skew has been corrected by the skew correction rollers 203 reaches a sensing area of the position displacement sensor 204*c*, as illustrated in FIG. 9 (S1205). Then, the position displacement sensor 204*c* outputs a detection signal, and the positional displacement controller 51 (shift correction control unit 301) detects the amount of displacement in response to the detection signal (S1206).

When the detected amount of displacement is at or below a predetermined value (YES in S1207), the positional displacement controller 51 drives the shift motor 303 via the motor control unit 302. The pair of shift rollers 305 are moved by Δx from the waiting position (HP) in a displaced direction in accordance with the amount of displacement detected in step S1206 before the sheet S reaches the pair of shift rollers 305, as illustrated in FIG. 9 (S1208).

When the sheet S reaches the pair of shift rollers 305 (S1209), an operation of shift correction is performed in which the shift motor 303 is driven such that the pair of shift rollers 305 are shifted in a direction opposite to the displaced direction (S1210). When such a shift correction operation is performed, each of the pair of shift rollers 305 is returned to the HP, as illustrated in FIG. 10. After the completion of the shift correction operation, the sheet S is conveyed toward the transferred unit.

When the amount of displacement detected by the position displacement sensor 204*c* exceeds the predetermined value (NO in S1207), it is determined that the amount of displacement is large. Thus, error is indicated on a display unit (not shown) of the main body 1A (S1211), and a print operation is stopped (S1212).

As described above, in the present embodiment, before the sheet reaches the pair of shift rollers 305, the pair of shift rollers 305 are shifted in a direction in which the sheet is displaced in advance in accordance with the amount of displacement of the sheet. Therefore, in correction of positional displacement, a shift operation can be performed while the pair of shift rollers 305 maintains at a balanced state to the sheet being conveyed by the pair of shift rollers 305. As a result, irrespective of the sheet size, the displacement of the sheet can be corrected with high precision without being affected by slippage even when the amount of displacement is large.

Figure 12A:
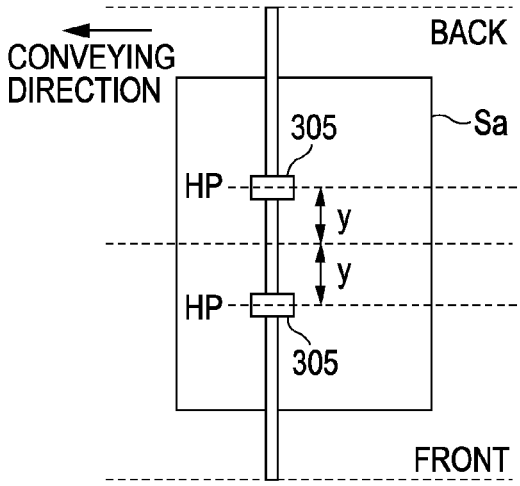
FIGS. 12A to 12D illustrate how a pair of correction rollers in the sheet correcting unit included in the sheet conveying device according to a second embodiment of the present invention changes its home position.
Figure 12B:
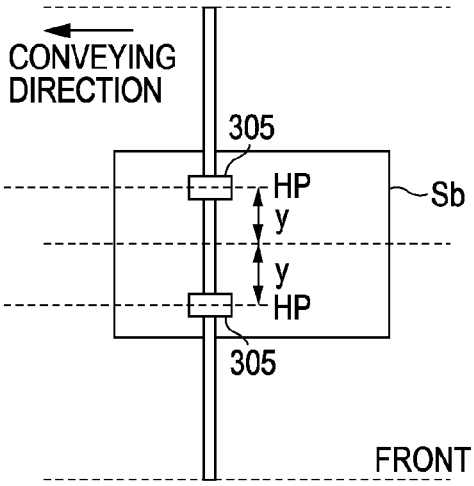

In the foregoing description, the gap between the pair of shift rollers is fixed, as illustrated in FIGS. 12A and 12B, that is, the pair of shift rollers are shifted while maintaining the distance y from the conveyance reference, irrespective of the sheet size.

Figure 12C:
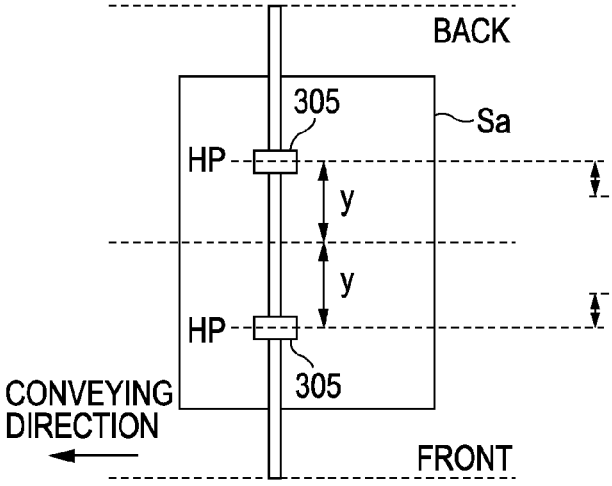
Figure 12D:
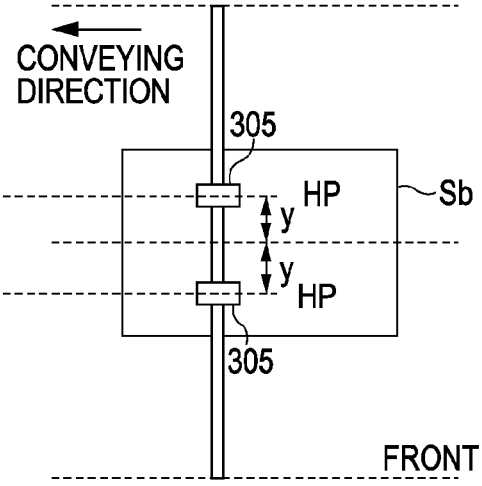

However, the present invention is not limited to this case. As illustrated in FIGS. 12C and 12D, the gap between the pair of shift rollers may be variable according to the sheet size, that is, the HP of each of the pair of shift rollers 305 may be changed according to the sheet size. In this case, a shift operation can be performed while the pair of shift rollers 305 are situated in the substantially central portion of the sheet S, irrespective of the sheet size. Therefore, the shift operation can be performed with high precision without slippage.

Such a mode, in which the HP of each of the pair of shift rollers 305 is changed according to the sheet size, will now be described as a second embodiment of the present invention.

Figure 13:
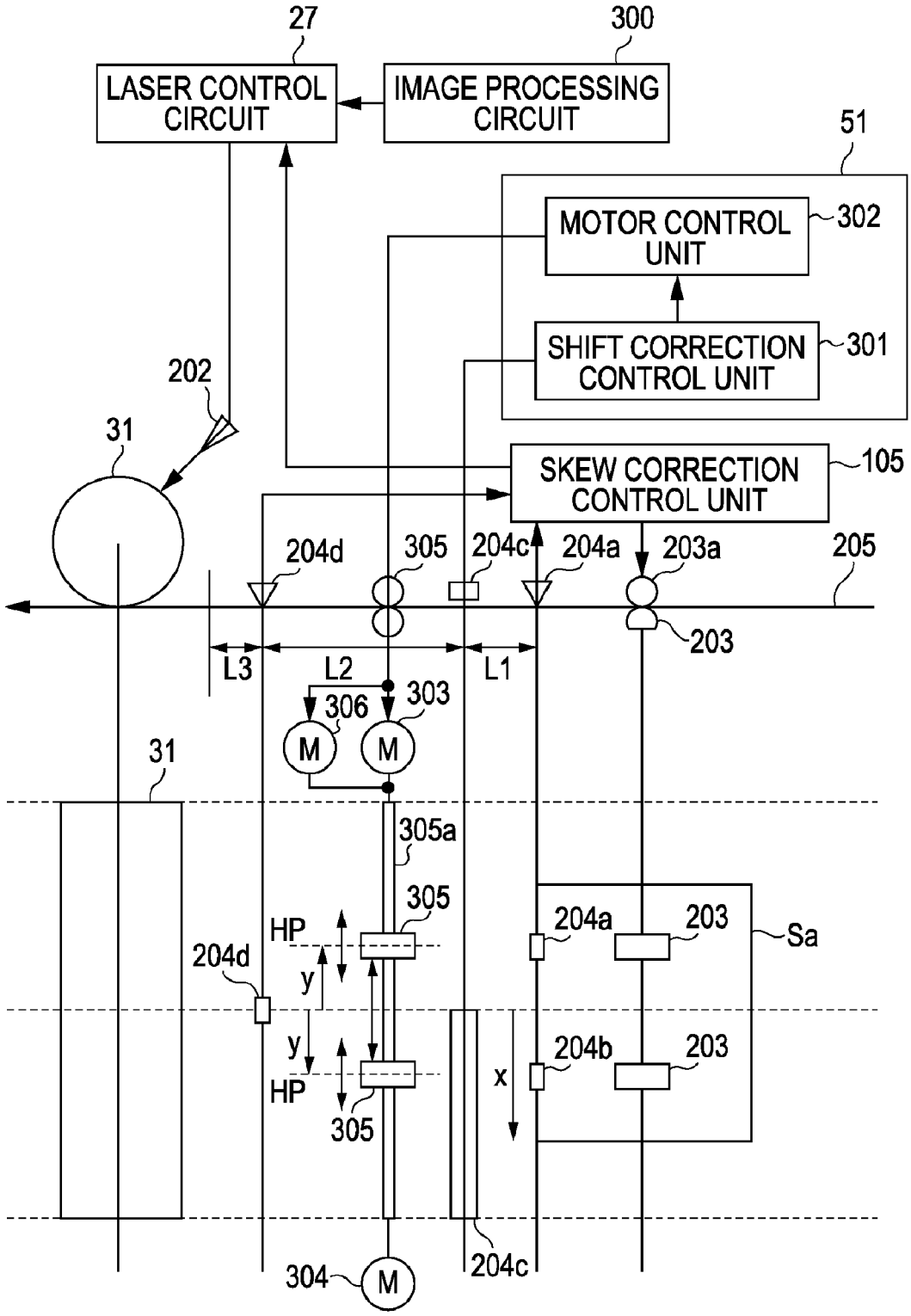
FIG. 13 illustrates a structure and a control block diagram of the sheet correcting unit included in the sheet conveying device according to the second embodiment.

FIG. 13 illustrates a structure and a control block diagram of the sheet correcting unit 50 included in the sheet conveying device according to the present embodiment. In FIG. 13, the same reference numerals as in FIG. 2 indicate equivalent or corresponding parts.

In FIG. 13, an HP change motor 306 is a motor that changes the HP of each of the pair of shift rollers 305. The HP change motor 306 enables the distance y from the conveyance reference for each of the pair of shift rollers 305 to be changed according to the sheet size. That is, in the present embodiment, the HP change motor 306 being a gap changing portion enables the gap between the shift rollers in a direction substantially perpendicular to the sheet conveying direction to be changed according to the length of the sheet in the width direction.

In the present embodiment, the two shift rollers 305 are coaxially disposed on a shaft 305*a*, movable along the shaft 305*a* (i.e., in the axial direction), and rotatably integral with the shaft 305*a*.

The HP is a position that is displaced from the conveyance reference by y in a direction substantially perpendicular to the sheet conveying direction. The distance y is, for example, one quarter of the length of the sheet S in the width direction. For example, when the sheet S is an A4-size sheet, the distance y is approximately 74.25 mm; when it is a B5R-size sheet, the distance y is approximately 81.25 mm; when it is a 13-inch size sheet, the distance y is approximately 81.25 mm.

In the present embodiment, each of the pair of shift rollers 305 can be moved to a position of the conveyance reference of the sheet S by the HP change motor 306, irrespective of the sheet size, as illustrated in FIGS. 12C and 12D. Therefore, a shift operation can be performed with high precision without slippage.

Figure 14:
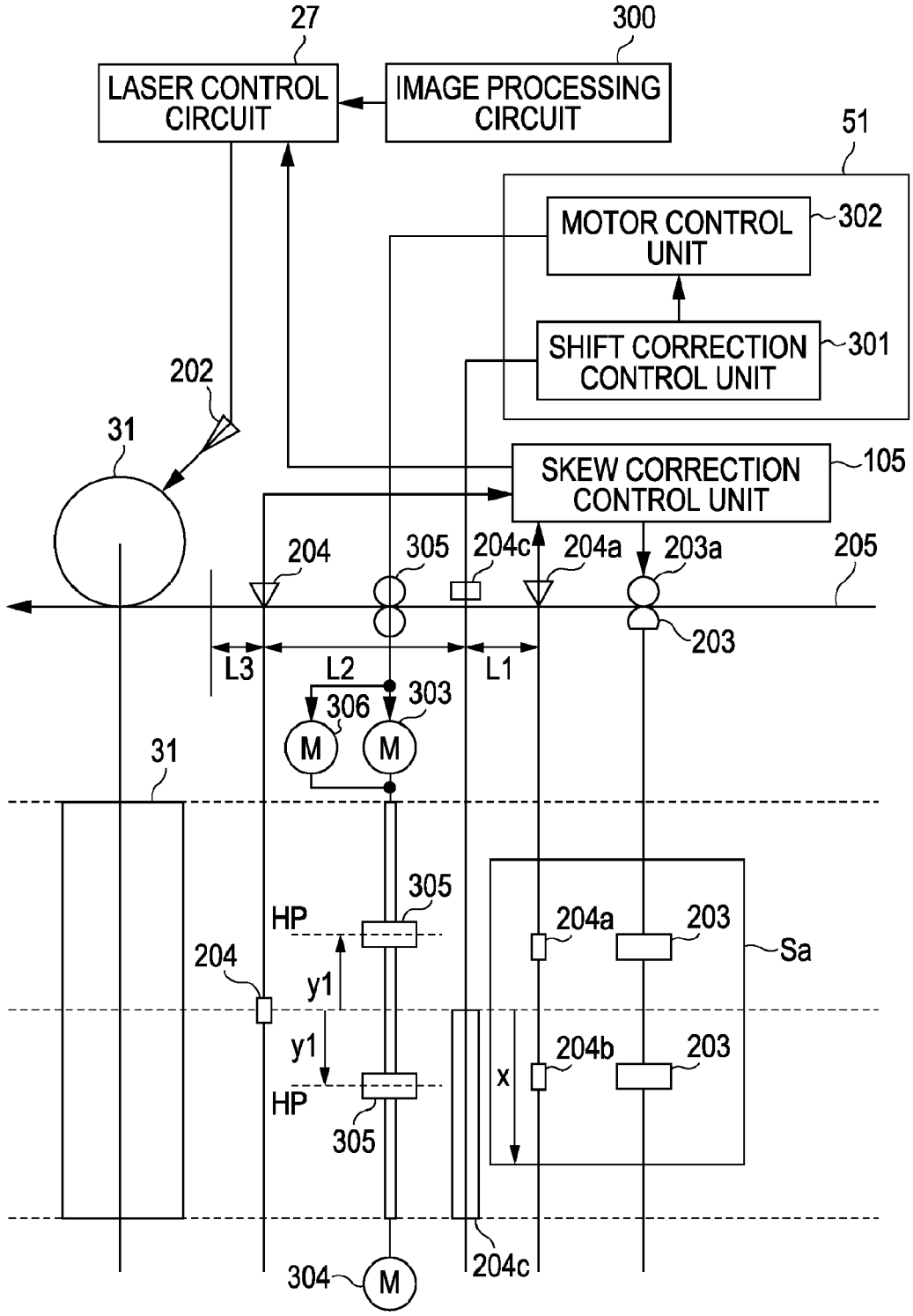
FIG. 14 is a first illustration for describing how the sheet correcting unit corrects a positional displacement of a sheet.

FIG. 14 illustrates the HPs of the pair of shift rollers 305 when a large sheet Sa is conveyed. In this case, the distance between the HP of each of the pair of shift rollers 305 and the conveyance reference is equal to approximately one quarter of the length of the sheet Sa in the width direction and is y1. That is, each of the pair of shift rollers 305 moves and waits at such HP according to the sheet size before the sheet Sa reaches the pair of shift rollers 305.

When the sheet Sa is conveyed with a displacement of Δx, the sheet Sa passes through the position displacement sensor 204*c*. When the sheet Sa passes in such a way, the positional displacement controller 51 (shift correction control unit 301) detects the amount of displacement Δx in response to a signal from the position displacement sensor 204*c*.

When the amount of displacement Δx is detected in this way, the positional displacement controller 51 shifts the pair of shift rollers 305 by Δx via the motor control unit 302 in a direction substantially perpendicular to the sheet conveying direction. Therefore, a shift operation can be performed when the pair of shift rollers 305 are always situated in the substantially central portion of the sheet. Accordingly, the shift operation can be performed with high precision with less slippage.

Figure 16:
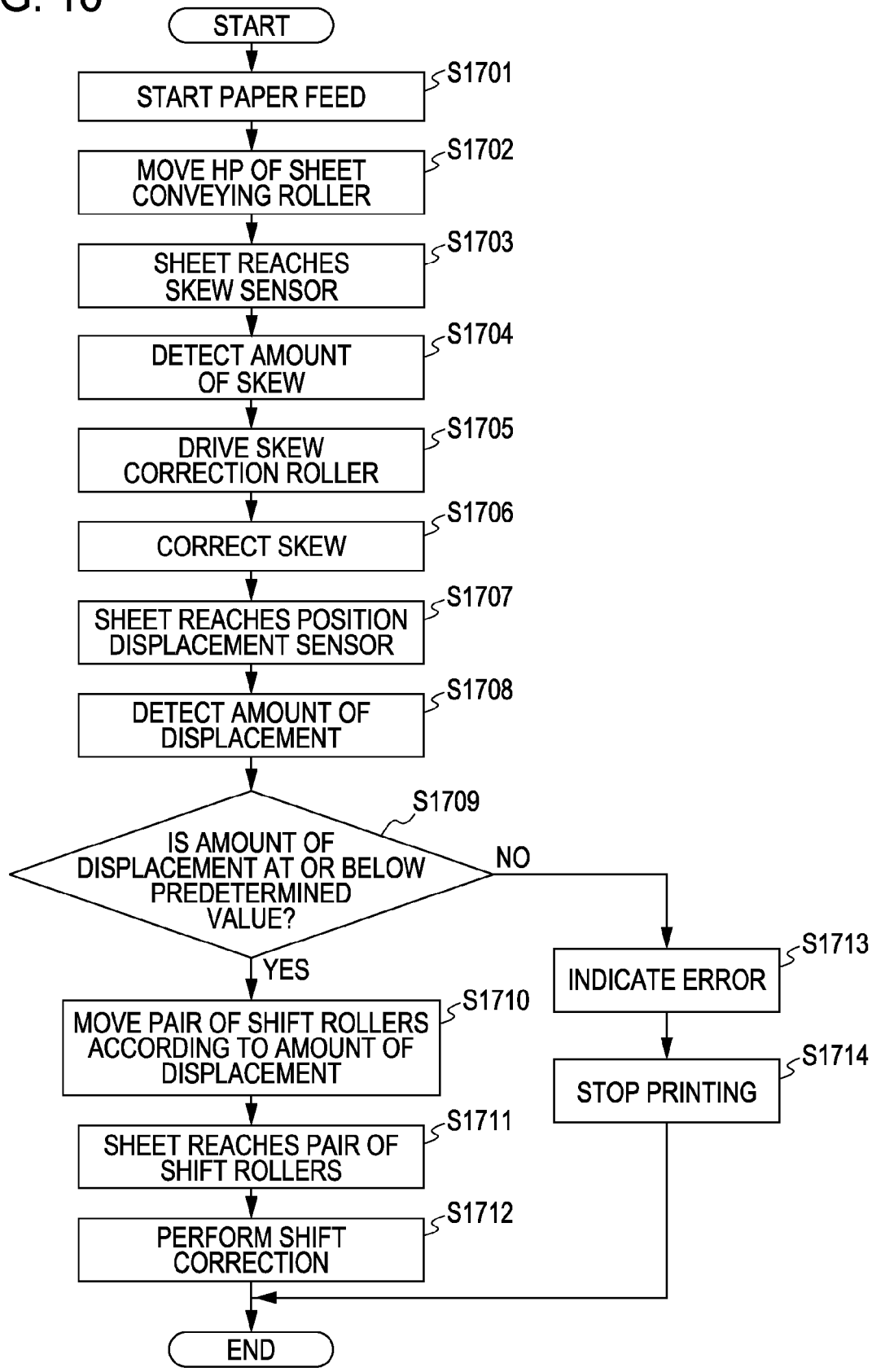
FIG. 16 is a flowchart that illustrates a process for correcting a skew and a positional displacement performed by the sheet correcting unit.

An operation of skew correction and shift control of the present embodiment will be described below with reference to the flowchart of FIG. 16.

When a paper feed operation starts (S1701), each of the pair of shift rollers 305 moves to the HP according to the sheet size (S1702). When the sheet Sa reaches a sensing area of the skew sensors 204*a* and 204*b* (S1703), as illustrated in FIG. 13, the skew correction control unit 105 detects the amount of skew in response to a signal from the skew sensors 204*a* and 204*b* (S1704). The skew correction control unit 105 drives the skew correction rollers 203 in accordance with the detected amount of skew (S1705), and an operation of skew correction is completed (S1706).

The sheet Sa whose skew has been corrected by the skew correction rollers 203 passes through the skew sensors 204*a* and 204*b*, as illustrated in FIG. 14. When the sheet Sa reaches a sensing area of the position displacement sensor 204*c* (S1707), the positional displacement controller 51 (shift correction control unit 301) detects the amount of displacement in response to the detection signal from the position displacement sensor 204*c* (S1708).

Figure 15:
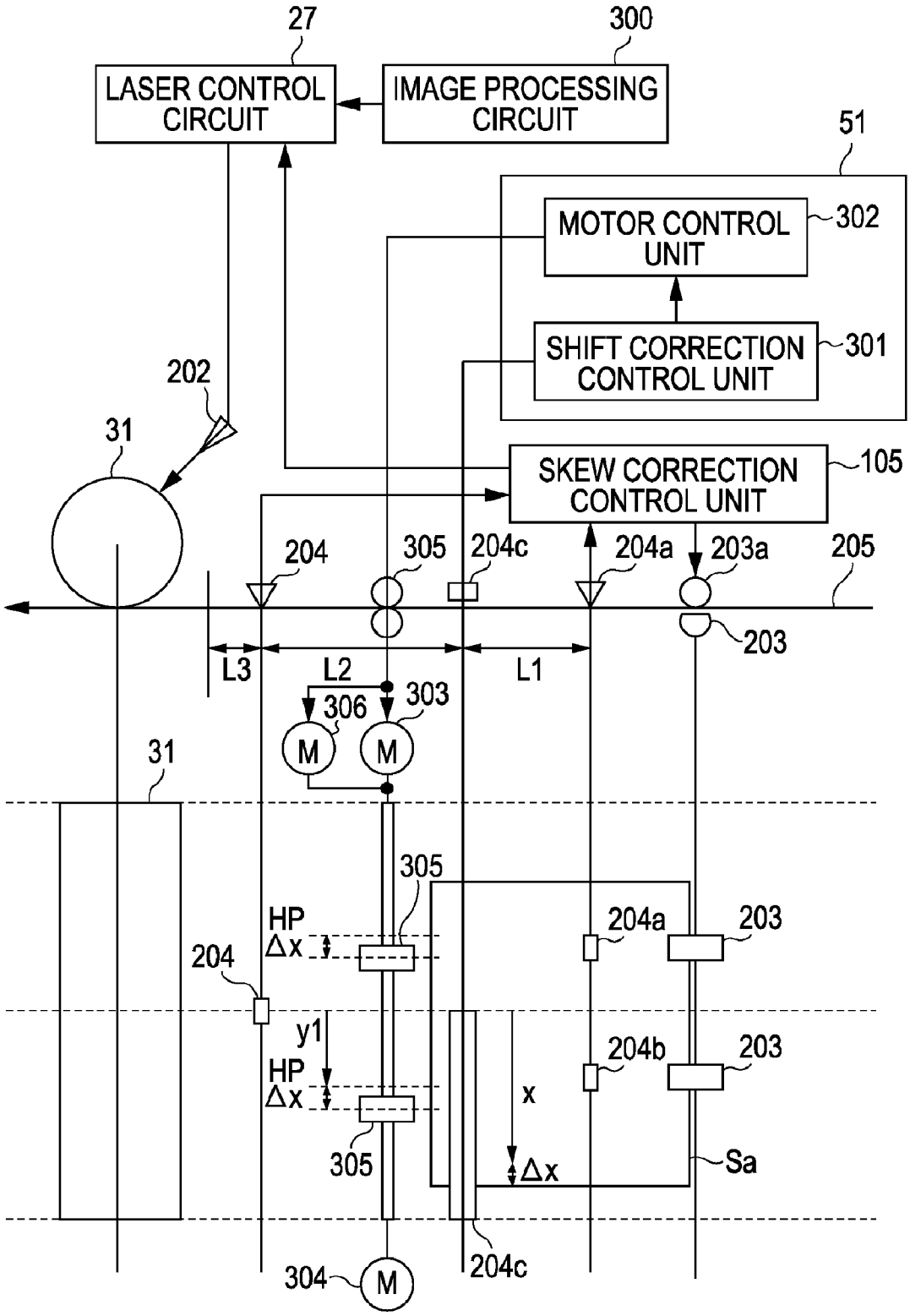
FIG. 15 is a second illustration for describing how the sheet correcting unit corrects a positional displacement of a sheet.

When the detected amount of displacement is at or below a predetermined value (YES in S1709), the positional displacement controller 51 drives the shift motor 303 via the motor control unit 302. The pair of shift rollers 305 are moved by Δx from the waiting position (HP) in a displaced direction in accordance with the amount of displacement detected in step S1708 before the sheet Sa reaches the pair of shift rollers 305, as illustrated in FIG. 15 (S1710).

When the sheet Sa reaches the pair of shift rollers 305 (S1711), an operation of shift correction is performed in which the shift motor 303 is driven such that the pair of shift rollers 305 are shifted in a direction opposite to the displaced direction (S1712). When such a shift correction operation is performed, each of the pair of shift rollers 305 is returned to the HP. After the completion of the shift correction operation, the sheet S is conveyed toward the transferred unit.

When the amount of displacement detected by the position displacement sensor 204*c* exceeds the predetermined value (NO in S1709), it is determined that the amount of displacement is large. Thus, error is indicated on a display unit (not shown) of the main body 1A (S1713), and a print operation is stopped (S1714).

As described above, the gap between the pair of shift rollers is changed by changing the HP according to the sheet size. Therefore, irrespective of the sheet size, a shift operation can be performed while pinching the sheet always in the vicinity of the central portion of the sheet. Accordingly, stable shift correction can be performed without influence of slippage.

In the foregoing description, the pair of shift rollers 305 are driven by the single shift motor 303 and the single convey motor 304. However, the pair of shift rollers 305 may be independently driven. The position displacement sensor 204*c* is not limited to an image sensor, such as a CIS or CCD. The position displacement sensor 204*c* may be a distance sensor or an optical sensor.

In the foregoing description, the sheet correcting unit uses the two shift rollers 305. However, the present invention is not limited to this. Three or more shift rollers 305 may be disposed. When three or more shift rollers 305 are used, before the sheet reaches the shift rollers, the shift rollers 305 are shifted from their waiting positions in a displaced direction such that the distances from shift rollers at both sides to the center of the sheet in the width direction are the same.

In the foregoing description, the digital copier (image forming apparatus) uses a structure in which an image is directly transferred to a sheet. However, the digital copier (image forming apparatus) may also use a structure in which an image is transferred to a sheet via an intermediate transfer member.

In the foregoing description, the present invention is applied to a digital copier (image forming apparatus). However, the present invention is also applicable to other apparatuses that handle sheets, such as an image reading apparatus that reads an image formed on a sheet and a sheet processing apparatus (e.g., a finishing apparatus). The sheet conveying device according to the present invention is not limited to an image forming apparatus and can be incorporated in various apparatuses that handle sheets. By use of this, the positional displacement and skew of a sheet, such as a document or a transfer medium, can be corrected.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-096938 filed Apr. 2, 2007, which is hereby incorporated by reference herein in its entirety.

What is claimed is:

1. A sheet conveying device for conveying a sheet, the sheet conveying device comprising:

an image sensor configured to sense a position of a side end of the sheet in the width direction;

a displacement-amount detecting unit configured to detect an amount of displacement of a conveyed sheet from a conveyance reference in a width direction being substantially perpendicular to a sheet conveying direction in response to a signal from the image sensor; and a pair of sheet conveying rollers configured to be shiftable in a direction substantially perpendicular to the sheet conveying direction while pinching the sheet having the amount of displacement detected by the displacement-amount detecting unit, wherein, before the sheet reaches the sheet conveying rollers, the sheet conveying rollers are shifted based on the amount of displacement detected by the displacement-amount detecting unit from a conveyance-reference position in a direction in which the sheet is displaced and, after the sheet reaches the sheet conveying rollers, the sheet conveying rollers are shifted while pinching the sheet so as to reduce the amount of displacement.

2. A sheet conveying device for conveying a sheet, the sheet conveying device comprising:

a sensor configured to sense a position of a side end of the sheet in the width direction;

a displacement-amount detecting unit configured to detect an amount of displacement of a conveyed sheet from a conveyance reference in a width direction being substantially perpendicular to a sheet conveying direction in response to a signal from the image sensor;

a pair of sheet conveying rollers configured to be shiftable in a direction substantially perpendicular to the sheet conveying direction while pinching the sheet having the amount of displacement detected by the displacement-amount detecting unit, and the pair of sheet conveying rollers are coaxially disposed in the direction substantially perpendicular to the sheet conveying direction; and a gap changing portion configured to change the gar between the sheet conveying rollers based on a length of the conveyed sheet in the width direction, wherein, before the sheet reaches the sheet conveying rollers, the sheet conveying rollers are shifted such that a center of a gap between the pair of sheet conveying rollers matches with a center of the conveyed sheet in the width direction and, after the sheet reaches the sheet conveying rollers, the sheet conveying rollers are shifted while pinching the sheet such that the center of the gap between the sheet conveying rollers matches with a conveyance-reference position.

3. An image forming apparatus for forming an image on a sheet using an image forming portion, the image forming apparatus comprising:

a sensor configured to sense a position of a side end of the sheet in the width direction;

a displacement-amount detecting unit configured to detect an amount of displacement of a sheet conveyed toward the image forming portion from a conveyance reference in a width direction being substantially perpendicular to a sheet conveying direction in response to a signal from the image sensor;

a pair of sheet conveying rollers configured to be shiftable in a direction substantially perpendicular to the sheet conveying direction while pinching the sheet having the amount of displacement detected by the displacement-amount detecting unit, and the pair of sheet conveying rollers are coaxially disposed in the direction substantially perpendicular to the sheet conveying direction; and a gap changing portion configured to change the gar between the sheet conveying rollers based on a length of the conveyed sheet in the width direction, wherein, before the sheet reaches the sheet conveying rollers, the sheet conveying rollers are shifted such that a center of a gap between the pair of sheet conveying rollers matches with a center of the conveyed sheet in the width direction, and, after the sheet reaches the sheet conveying rollers, the sheet conveying rollers are shifted while pinching the sheet such that the center of the gap between the sheet conveying rollers matches with a conveyance-reference position.

* * * * *